US008820243B2

(12) United States Patent
McKinley et al.

(10) Patent No.: US 8,820,243 B2
(45) **Date of Patent: *Sep. 2, 2014**

(54) INTEGRATED ELECTRIC MATCH INITIATOR MODULE WITH ISOLATED LIFT AND BURST FUNCTION FOR A PYROTECHNIC DEVICE

(75) Inventors: Paul McKinley, Natick, MA (US); Phillip Martinez, Groton, NY (US)

(73) Assignee: MagicFire, Inc., Natick, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/374,261

(22) Filed: Dec. 19, 2011

(65) Prior Publication Data

US 2012/0304883 A1 Dec. 6, 2012

Related U.S. Application Data

(63) Continuation of application No. 11/800,621, filed on May 7, 2007, now Pat. No. 8,079,307, which is a continuation-in-part of application No. 11/725,152, filed on Mar. 16, 2007, now Pat. No. 7,617,777, and a continuation-in-part of application No. 11/243,649, filed on Oct. 5, 2005, now abandoned.

(60) Provisional application No. 60/798,015, filed on May 5, 2006.

(51) Int. Cl.

| | |
|---|---|
| ***F42B 4/00*** | (2006.01) |
| ***F42C 14/00*** | (2006.01) |
| ***F42C 11/00*** | (2006.01) |
| ***F42B 4/06*** | (2006.01) |
| ***F42D 1/055*** | (2006.01) |

(52) U.S. Cl.

CPC ..... *F42B 4/00* (2013.01); *F42C 11/001* (2013.01); *F42B 4/06* (2013.01); *F42D 1/055* (2013.01)

USPC ..... 102/357; 102/202.11

(58) Field of Classification Search

USPC ..... 102/335, 336, 342, 345, 351, 352, 357, 102/360, 202.11, 202.5, 206

See application file for complete search history.

(56) References Cited

U.S. PATENT DOCUMENTS

| | | | |
|---|---|---|---|
| 3,570,404 | A | 3/1971 | Pope |
| 4,015,531 | A | 4/1977 | Ziemba |

(Continued)

FOREIGN PATENT DOCUMENTS

| | | |
|---|---|---|
| AU | 6583/90 | 4/1991 |
| AU | 65853/90 | 5/1991 |

(Continued)

OTHER PUBLICATIONS

Toussalle, Raphael et al., Electronic Delay Detonator, Sep. 16, 1996.

(Continued)

*Primary Examiner* — James Bergin

(74) *Attorney, Agent, or Firm* — Pandiscio & Pandiscio

(57) ABSTRACT

An electric match assembly for initiating a pyrotechnic device, the electric match assembly comprising an element for connection to a leader carrying the signal; a first electric match component for connection to the lift charge of the pyrotechnic device, the first electric match component connected to the element such that when the element is connected to the leader and the first electric match component is connected to the lift charge, the signal in the leader is applied to the lift charge; a second electric match component for connection to the time fuse connected to the burst charge of the pyrotechnic device, the second electric match component connected to the element such that when the element is connected to the leader and the second electric match component is connected to the time fuse, the signal in the leader is applied to the time fuse of the burst charge.

14 Claims, 6 Drawing Sheets

(56) References Cited

U.S. PATENT DOCUMENTS

| | | | | |
|---|---|---|---|---|
| 4,068,592 | A | 1/1978 | Beuchat | |
| 4,144,814 | A | 3/1979 | Day et al. | |
| 4,239,005 | A | 12/1980 | Simmons | |
| 4,267,567 | A | 5/1981 | Nygaard et al. | |
| 4,307,665 | A * | 12/1981 | Block et al. | 102/505 |
| 4,335,653 | A | 6/1982 | Bratt et al. | |
| 4,354,432 | A | 10/1982 | Cannavo et al. | |
| 4,363,272 | A | 12/1982 | Simmons | |
| 4,409,898 | A | 10/1983 | Blix et al. | |
| 4,419,933 | A | 12/1983 | Kirby et al. | |
| 4,537,131 | A | 8/1985 | Saunders | |
| 4,586,437 | A | 5/1986 | Miki et al. | |
| 4,632,031 | A | 12/1986 | Jarrott et al. | |
| 4,633,779 | A | 1/1987 | Biggs et al. | |
| 4,641,580 | A | 2/1987 | Ogatsu | |
| 4,674,047 | A | 6/1987 | Tyler et al. | |
| 4,703,693 | A | 11/1987 | Spies et al. | |
| 4,712,477 | A | 12/1987 | Aikou et al. | |
| 4,825,765 | A | 5/1989 | Ochi et al. | |
| 4,829,899 | A | 5/1989 | Wiker et al. | |
| 4,848,232 | A | 7/1989 | Kurokawa et al. | |
| 4,884,506 | A | 12/1989 | Guerreri | |
| 4,962,706 | A | 10/1990 | Ivermee et al. | |
| 5,014,622 | A | 5/1991 | Jullian | |
| 5,069,129 | A | 12/1991 | Kunitomo | |
| 5,123,355 | A | 6/1992 | Hans et al. | |
| 5,214,236 | A | 5/1993 | Murphy et al. | |
| 5,229,541 | A | 7/1993 | Will et al. | |
| 5,295,438 | A | 3/1994 | Hill et al. | |
| 5,308,149 | A | 5/1994 | Watson et al. | |
| 5,335,598 | A | 8/1994 | Lewis et al. | |
| 5,339,741 | A | 8/1994 | Craven et al. | |
| 5,363,765 | A | 11/1994 | Aikou et al. | |
| 5,440,990 | A | 8/1995 | Wiedefeld et al. | |
| 5,499,579 | A | 3/1996 | Lewis | |
| 5,520,114 | A | 5/1996 | Guimard et al. | |
| 5,526,750 | A | 6/1996 | Poor et al. | |
| 5,544,585 | A | 8/1996 | Duguet | |
| 5,559,303 | A | 9/1996 | La Mura et al. | |
| 5,563,366 | A | 10/1996 | La Mura et al. | |
| 5,571,985 | A | 11/1996 | Ritter et al. | |
| 5,621,184 | A | 4/1997 | Gwynn, III | |
| 5,623,117 | A | 4/1997 | Lewis | |
| 5,627,338 | A | 5/1997 | Poor et al. | |
| 5,691,500 | A | 11/1997 | Mancini | |
| 5,739,462 | A | 4/1998 | Poor et al. | |
| 5,894,103 | A | 4/1999 | Shann | |
| 5,912,428 | A | 6/1999 | Patti | |
| 6,082,265 | A | 7/2000 | Sakamoto et al. | |
| 6,173,651 | B1 | 1/2001 | Pathe et al. | |
| 6,490,977 | B1 | 12/2002 | Bossarte et al. | |
| 6,857,369 | B2 | 2/2005 | Bossarte et al. | |
| 7,194,959 | B2 | 3/2007 | Bossarte et al. | |
| 7,493,859 | B2 | 2/2009 | Russell | |
| 7,617,777 | B2 | 11/2009 | Bossarte et al. | |
| 7,757,607 | B1 | 7/2010 | Deye | |
| 8,136,448 | B2 | 3/2012 | Nelson et al. | |
| 8,220,392 | B1 * | 7/2012 | Maldonado et al. | 102/368 |
| 2006/0086277 | A1 | 4/2006 | Bossarte et al. | |

FOREIGN PATENT DOCUMENTS

| | | |
|---|---|---|
| GB | 2 121 089 | 12/1983 |
| WO | WO 92/08932 | 5/1992 |
| WO | WO 01/22180 | 3/2001 |

OTHER PUBLICATIONS

Boucher, Craig et al., Electronic Pyrotechnic Ignitors: Technology Status Report, Oct. 6-10, 2003, 421-424.

* cited by examiner

INTEGRATED ELECTRIC MATCH INITIATOR MODULE WITH ISOLATED LIFT AND BURST FUNCTION FOR A PYROTECHNIC DEVICE

REFERENCE TO PENDING PRIOR PATENT APPLICATIONS

This patent application is a continuation of prior U.S. patent application Ser. No. 11/800,621, filed May 7, 2007, now U.S. Pat. No. 8,079,307, by Paul McKinley et al. for INTEGRATED ELECTRIC MATCH INITIATOR MODULE WITH ISOLATED LIFT AND BURST FUNCTION FOR A PYROTECHNIC DEVICE, which in turn:

(i) is a continuation-in-part of prior U.S. patent application Ser. No. 11/725,152, filed Mar. 16, 2007, now U.S. Pat. No. 7,617,777, by George Bossarte et al. for PRECISION PYROTECHNIC DISPLAY SYSTEM AND METHOD HAVING INCREASED SAFETY AND TIMING ACCURACY;

(ii) is a continuation-in-part of prior U.S. patent application Ser. No. 11/243,649, filed Oct. 5, 2005 now abandoned by George Bossarte et al. for PRECISION PYROTECHNIC DISPLAY SYSTEM AND METHOD HAVING INCREASED SAFETY AND TIMING ACCURACY; and (iii) claims benefit of prior U.S. Provisional Patent Application Ser. No. 60/798,015, filed May 5, 2006 by Paul McKinley et al. for ANALYSIS AND DESIGN OF AN INTEGRATED ELECTRIC MATCH INITIATOR MODULE WITH ISOLATED LIFT AND BURST FUNCTION.

FIELD OF THE INVENTION

This invention relates to pyrotechnic displays in general, and more particularly to methods and apparatus for controlling the launch and burst of pyrotechnic devices in a fireworks display.

BACKGROUND OF THE INVENTION

The unintentional initiation (i.e., firing) of a pyrotechnic device (i.e., fireworks projectile) is a most unforgiving event. Frequently, pyrotechnicians are present, often resulting in personnel injury or death. Equally common is the proximity of the initiated device to other pyrotechnic devices, potentially resulting in an uncontrolled escalation of the initial unintended initiation event into widespread unintended initiation events, with attendant major losses and destruction. This so-called "chain-reaction" is the by-product of a single pyrotechnic device communicating with, and initiating, other adjacent pyrotechnic devices. Once initiated, this chain-reaction can proceed so rapidly as to result in an event sometimes described as a "mass detonation".

Several recent chain-reaction events have been well documented and studied. While each studied event was unique, communication between adjacent pyrotechnic devices was a universal theme and, ultimately, the cause of the resulting destruction and personnel trauma. Simply stated, without the presence of initiation communication between the several pyrotechnic devices, the event might have been limited solely to the initiation of the first pyrotechnic device.

As an analogous concept, consider a burn test of a single pyrotechnic device. With certainty, the test burn will ultimately initiate the device. Now consider a burn test of multiple pyrotechnic devices, much as the industry does when evaluating packaging concepts. The initiation of the first pyrotechnic device produces two results: (i) as a consequence of initiating the primary device's lift charge, the resultant pressure wave attempts to disburse (i.e., spatially separate) the adjacent pyrotechnic devices; and (ii) as a consequence of the primary initiation's thermal output, some number of the secondary pyrotechnic devices will also be initiated.

It should be noted that the initiation of a pyrotechnic device generally means that both the lift charge and, as a consequence, the burst charge, will initiate. This is because, in contemporary pyrotechnic device construction, the initiation of the time fuse for the burst charge is tied to initiation of the lift charge. This is done either by (i) using initiation of the lift charge to initiate the time fuse of the burst charge (i.e., "bottom fused"), or (ii) using a short length of quickmatch to initiate the time fuse of the burst charge (i.e., "top fused").

More particularly, and looking now at FIG. 1, where the pyrotechnic device is a bottom fused device, the "leader" directly ignites the lift charge, which in turn ignites the time fuse for the burst charge. Where the pyrotechnic device is a top fused device, the leader directly ignites both the lift charge and the time fuse for the burst charge. In FIG. 1, the bottom fused construction is characterized as "alt".

It is believed that, in chain-reaction events, the initiation of the burst charge is the more serious consequence. This is because it is the by-products of a burst initiation (namely, multiple flaming pyrotechnic compositions, each having a duration of several seconds) which typically initiate adjacent pyrotechnic devices.

SUMMARY OF THE INVENTION

Accordingly, the present invention provides an improved approach for controlling initiation of a pyrotechnic device's lift charge and burst charge, whereby to reduce the possibility of chain-reaction events, including mass detonation events. More particularly, the present invention provides a novel means for the independent initiation of the pyrotechnic device's lift charge and burst charge. By isolating initiation of the lift charge from initiation of the burst charge, the unintentional initiation of a lift charge will, to first order, only result in the creation of a pressure wave, whose tendency will be to simply disburse any adjacent pyrotechnic devices. While this unintentional initiation event may create thermal energy generated by the lift charge initiation, this thermal energy will typically have only a very brief duration, with little or no flaming by-products. As a result, there is very little likelihood that the initiation of a single pyrotechnic device will turn into a chain-reaction event, including a mass detonation event.

It is believed that, by providing a novel electric match assembly which provides a novel approach for isolating the initiation of a pyrotechnic device's lift charge and burst charge, the likelihood of chain-reaction events can be reduced. This novel electric match assembly essentially comprises an integrated electric match initiator module with isolated lift and burst function, as will hereinafter be discussed in further detail.

In one form of the present invention, there is provided an electric match assembly for initiating a pyrotechnic device in response to a signal, the electric match assembly comprising:

a first element for connection to a leader carrying the signal;

a first electric match component for connection to the lift charge of the pyrotechnic device, the first electric match component being connected to the first element such that when the first element is connected to the leader and the first electric match component is connected to the lift charge, the signal in the leader is applied to the lift charge;

a second electric match component for connection to the time fuse connected to the burst charge of the pyrotechnic device, the second electric match component being connected to the first element such that when the first element is connected to the leader and the second electric match component is connected to the time fuse, the signal in the leader is applied to the time fuse of the burst charge.

In another form of the present invention, there is provided a pyrotechnic device comprising:

a lift charge;

a burst charge;

a time fuse connected to the burst charge;

a first element for connection to a leader carrying an initiation signal;

a first electric match component connected to the lift charge, the first electric match component being connected to the first element such that when the first element is connected to the leader, the initiation signal in the leader is applied to the lift charge; and a second electric match component connected to the time fuse connected to the burst charge, the second electric match component being connected to the first element such that when the first element is connected to the leader, the initiation signal in the leader is applied to the time fuse of the burst charge.

In another form of the present invention, there is provided a method for initiating a pyrotechnic device, the method comprising the steps of:

providing:

a leader;

a first element for connection to the leader;

a first electric match component for connection to the lift charge of the pyrotechnic device, the first electric match component being connected to the first element; and a second electric match component for connection to the time fuse connected to the burst charge of the pyrotechnic device, the second electric match component being connected to the first element;

connecting the first electric match component to the lift charge of the pyrotechnic device, connecting the second electric match component to the time fuse of the pyrotechnic device, and connecting the first element to the leader; and applying an initiation signal to the leader, whereby the first electric match component initiates the lift charge of the pyrotechnic device and the second electric match component initiates the time fuse connected to the burst charge of the pyrotechnic device.

In another form of the present invention, there is provided a method for initiating a pyrotechnic device, the method comprising the steps of:

providing:

a pyrotechnic device comprising:

a lift charge;

a burst charge; and a time fuse connected to the burst charge;

a leader;

a first element for connection to the leader;

a first electric match component for connection to the lift charge of the pyrotechnic device, the first electric match component being connected to the first element; and a second electric match component for connection to the time fuse connected to the burst charge of the pyrotechnic device, the second electric match component being connected to the first element;

connecting the first electric match component to the lift charge of the pyrotechnic device, connecting the second electric match component to the time fuse of the pyrotechnic device, and connecting the first element to the leader; and applying an initiation signal to the leader, whereby the first electric match component initiates the lift charge of the pyrotechnic device and the second electric match component initiates the time fuse connected to the burst charge of the pyrotechnic device.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like elements, and further wherein.

DETAILED DESCRIPTION OF THE PRESENT INVENTION

Novel Electric Match Assembly

As noted above, the present invention is designed to reduce the likelihood of a chain-reaction event, including a mass detonation event, by preventing the initiation of one pyrotechnic device's burst charge from initiating adjacent pyrotechnic devices. This is done by providing a novel construction which isolates the initiation of the lift charge from the initiation of the burst charge. As a result, the unintentional initiation of a pyrotechnic device's lift charge will not result in the unintentional initiation of its burst charge, thereby reducing the possibility of unintentionally initiating adjacent pyrotechnic devices.

In one preferred form of the present invention, this objective is achieved by the provision and use of a novel electric match assembly. This novel electric match assembly essentially comprises an integrated electric match initiator module with isolated lift and burst function. This approach reduces the likelihood that the unintended initiation of one pyrotechnic device's lift charge will result in the unintended initiation of that device's burst charge, thereby reducing the likelihood that then unintended initiation of that pyrotechnic device will result in the unintended initiation of adjacent pyrotechnic devices.

More particularly, conventional electric matches are now substantially universally used to electrically fire pyrotechnic devices in large, professional fireworks shows. Furthermore, conventional electric matches are also used (albeit with lower cost, manual electric firing systems) in many medium-sized pyrotechnic displays as well. Thus, replacing conventional electric matches with the new, safer electric match assemblies of the present invention, is consistent with industry practices.

Figure 1:
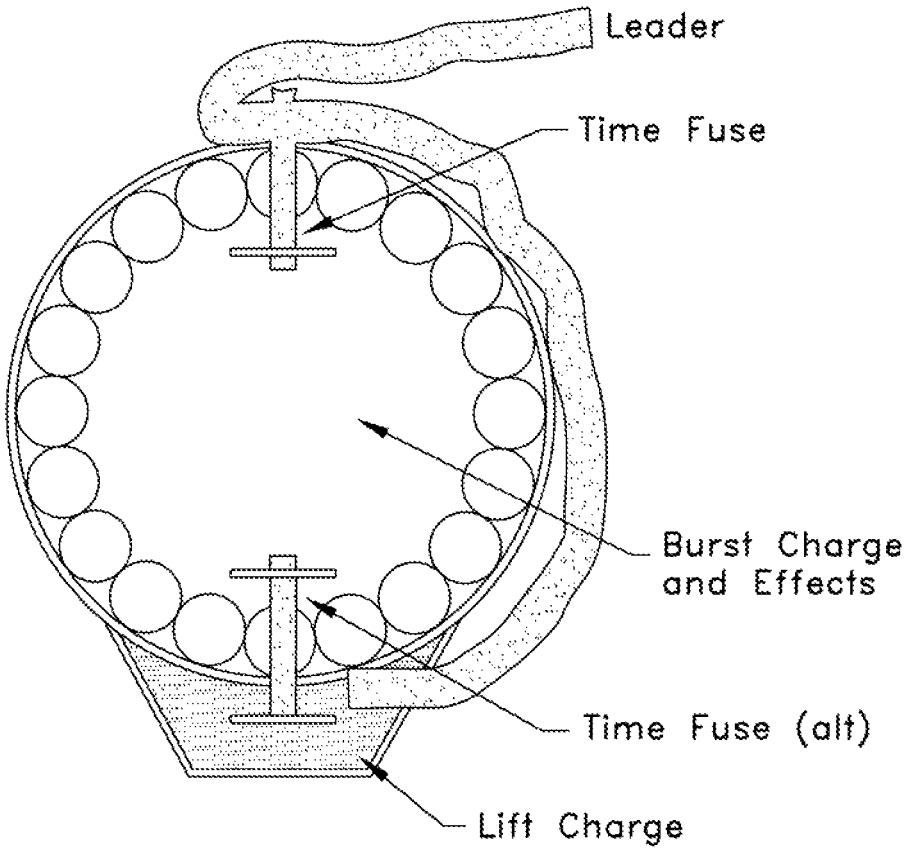
FIG. 1 Prior Art
FIG. 1 is a schematic illustration showing a conventional top fused (and, alternatively, bottom fused) pyrotechnic device.
Figure 2:
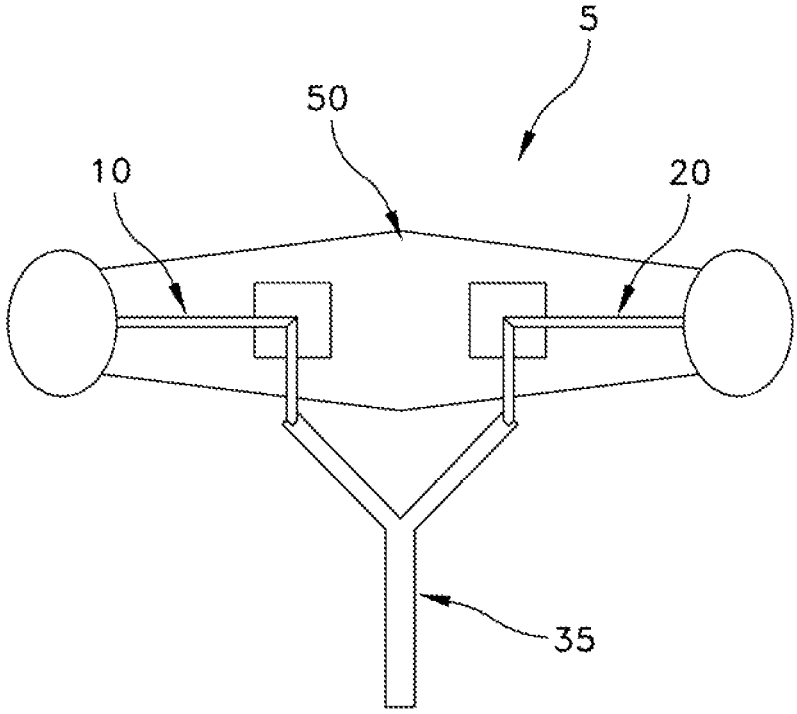
FIG. 2 is a schematic view illustrating a novel electric match assembly formed in accordance with the present invention.
Figure 3:
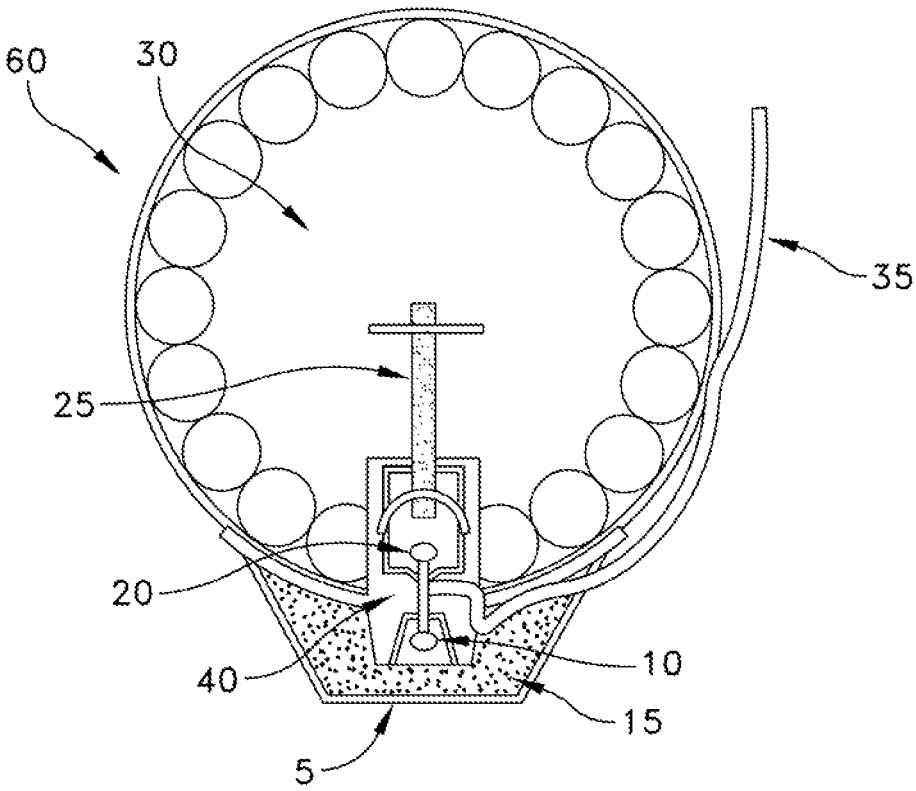
FIG. 3 is a schematic view illustrating a novel pyrotechnic device formed in accordance with the present invention.
Figure 4:
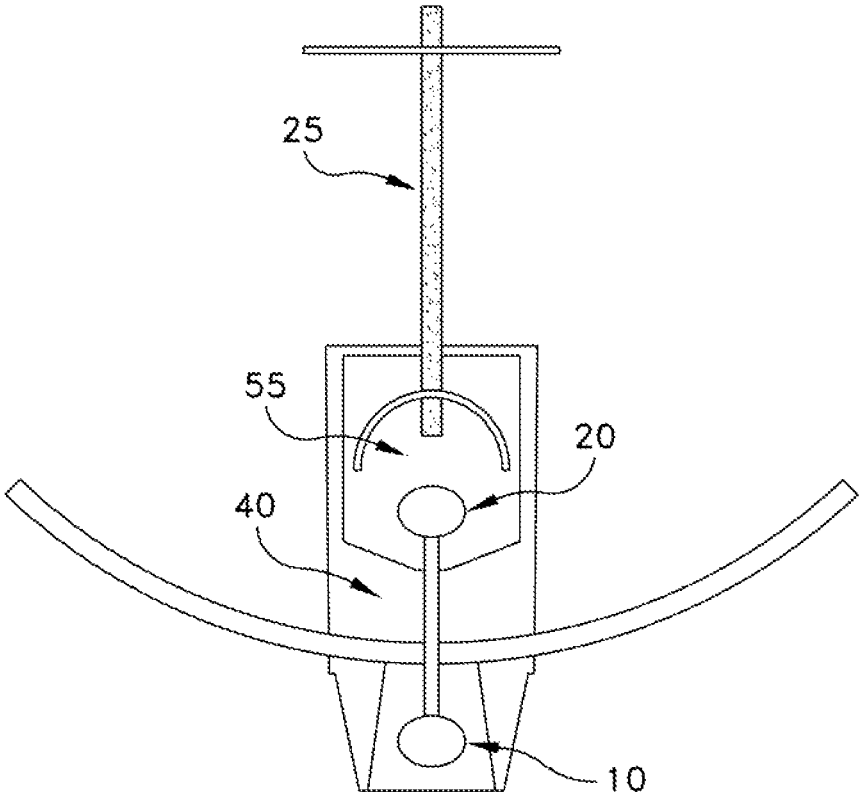
FIG. 4 is an enlarged schematic view illustrating selected portions of the device shown in FIG. 3.

Looking now at FIGS. 2, 3 and 4, there is provided a novel electric match assembly 5 formed in accordance with the present invention. Electric match assembly 5 essentially comprises two electric match components, i.e., a first electric match component 10 to initiate the lift charge 15, and a second electric match component 20 to initiate the time fuse 25 for the burst charge 30. Electric match assembly 5 is activated by the leader 35, which communicates with both first electric match component 10 and second electric match component 20. Shrouding (i.e., isolator) 40 isolates (i) the junction of second electric match component 20 and time fuse 25 from (ii) lift charge 15, so as to provide protection from the unintentional initiation of the time fuse of the burst charge.

Connecting first electric match component 10 and second electric match component 20 in series within novel electric match assembly 5 eliminates the undesirable possibility of one electric match component being defective, which could result in the initiation of one charge but not the other charge. Furthermore, from a manufacturing perspective, assembling novel electric match assembly 5 from dual, back-to-back electric match components, on a single substrate 50, is relatively easy and inexpensive.

Thus, in the preferred form of the invention, novel electric match assembly 5 essentially comprises a small, molded assembly integrating dual electric match components extending bi-laterally, such that one electric match component fires into the lift charge and the second electric match component fires into a chamber 55 enclosing the beginning of time fuse 25 for burst charge 30. Because both first electric match component 10 and second electric match component 20 function simultaneously with one another, the initiation of lift charge 15 and the initiation of time fuse 25 for burst charge 30 occur simultaneously.

Novel electric match assembly 5 of the present invention offers numerous advantages over the prior art. Among these are:

(i) novel electric match assembly 5 effectively prevents the unintentional initiation of time fuse 25 for burst charge 30 as a consequence of the unintentional initiation of lift charge 15;

(ii) novel electric match assembly 5 conveniently allows a pyrotechnic device manufacturer to utilize a time fuse 25 of the desired specification for burst charge 30;

(iii) the labor involved in manufacturing novel electric match assembly 5, and the labor involved in manufacturing a pyrotechnic device 60 incorporating novel electric match assembly 5, is not substantially different from the labor that is already required with conventional electric matches;

(iv) novel electric match assembly 5 is secure and well protected from the risks associated with impact and/or friction; and (v) novel electric match assembly 5 can be readily adapted for use with custom-designed pyrotechnic aerial shell topologies.

Testing of novel electric match assembly 5 has confirmed (i) the initiation of first electric match component 10 and second electric match component 20 occurs substantially simultaneously, and (ii) the successful elimination of unintentional communication between initiation of lift charge 15 and initiation of time fuse 25 for burst charge 30.

Pressure Relief in the Chamber Housing

The Second Electric Match Component

And the Time Fuse for the Burst Charge

In addition to the foregoing, it has also been discovered that, with the design shown in FIGS. 2-4, it is advantageous to relieve the pressure increase which typically occurs in chamber 55 which houses second electric match component 20 and time fuse 25 for burst charge 30. This is because initiation of second electric match component 20 and, consequently, time fuse 25 for burst charge 30, generally results in (i) a temperature increase within chamber 55, and (ii) a commensurate pressure increase within the chamber. This increase should be relieved in order to prevent chamber 55 from bursting due to excessive pressure. This can be accomplished by appropriately venting the chamber, e.g., by forming the chamber with appropriate vent holes in the region facing away from burst charge 30.

Alternatively, the increase in temperature and pressure within chamber 55 can be accommodated by forming the chamber with an increased structural integrity.

Production

Figure 5:
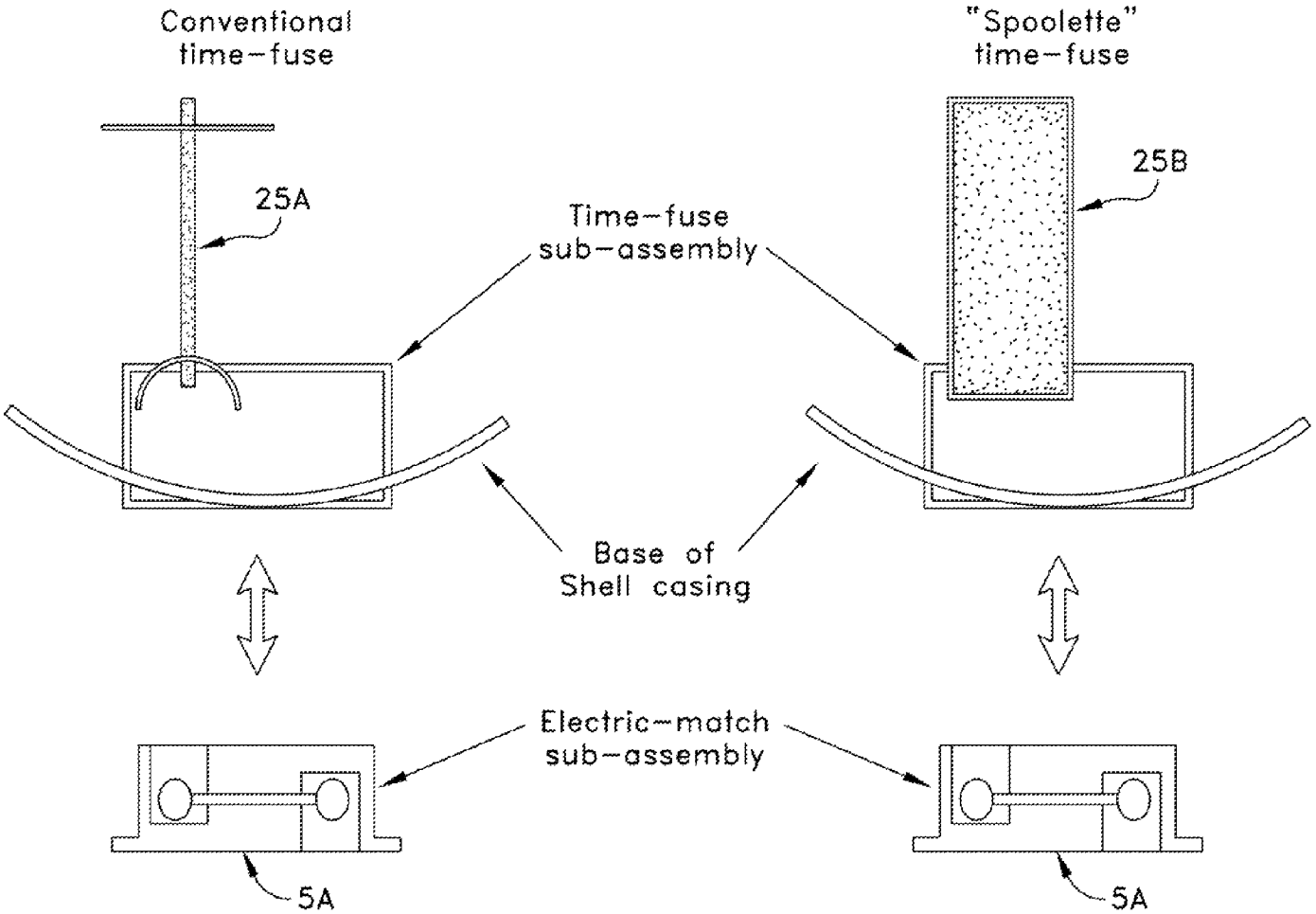
FIG. 5 is a schematic view illustrating various time fuse sub-assemblies and an electric match sub-assembly.

In addition to the foregoing, it has also been discovered that, with the design shown in FIGS. 2-4, is it advantageous for (i) time fuse 25 to be configured such that the time fuse may be installed in the shell casing prior to loading of the shell contents, but that novel electric match assembly 5 NOT be installed until completion of shell assembly; (ii) time fuse 25 to be configured to accommodate "spoolette"-style timing fuses. Accordingly, and looking now at FIG. 5, in one preferred form of the invention, time fuse 25 is configured as either (i) a sub-assembly which accommodates either conventional time fuse 25A, or (ii) a sub-assembly which accommodates a spoolette-type time fuse 25B. In either case, the time fuse sub-assembly may be installed into the shell casing prior to loading of the shell contents. Furthermore, a separate electric match sub-assembly 5A may be inserted into the time-fuse sub-assembly subsequent to final assembly of the shell.

Figure 6:
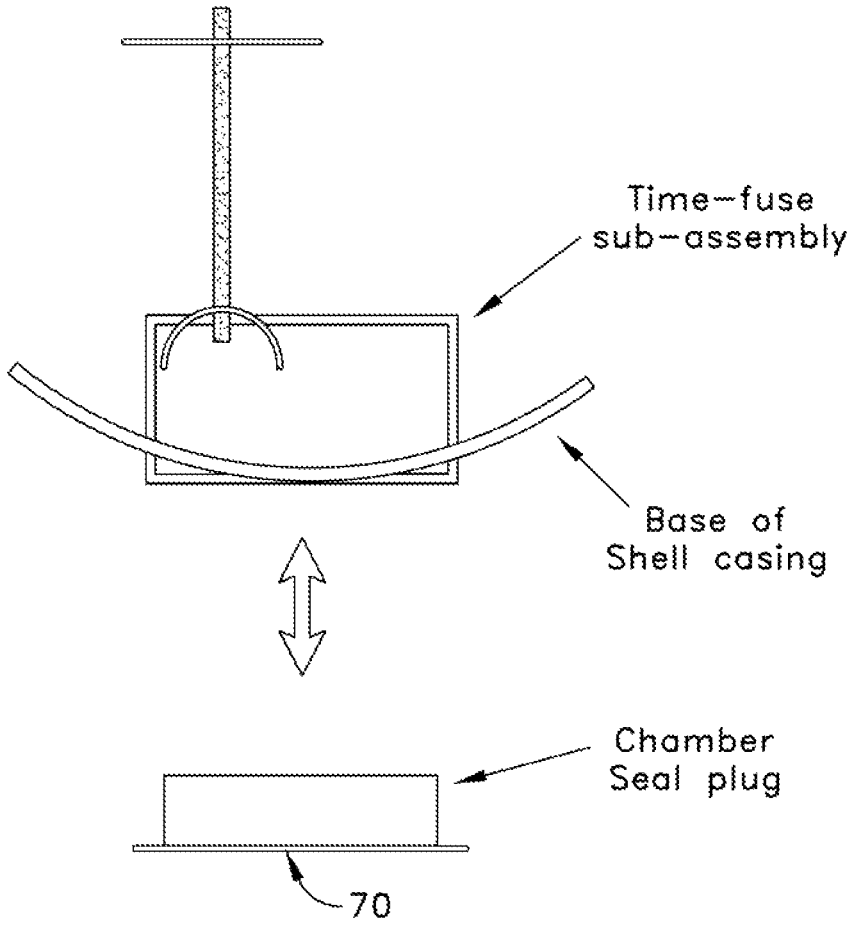
FIG. 6 is a schematic view illustrating a chamber seal plug which may be used in accordance with the present invention.

An additional benefit of separating the time-fuse sub-assembly from the novel electric match assembly is the opportunity to seal the time fuse chamber entrance with a safety plug 70 until such time as the manufacturer is ready to add the electric match sub-assembly 5A. See FIG. 6. This benefit provides a significant safety enhancement during shell construction and any subsequent transportation and/or storage of the finished shell prior to final installation of the electric match sub-assembly 5A, lift charge and preparation for use.

MODIFICATIONS OF THE PREFERRED EMBODIMENTS

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. An electric match assembly for initiating a pyrotechnic device in response to an initiation a signal, the electric match assembly being configured for connection to a leader carrying the initiation signal, the electric match assembly comprising:

a first electric match component for connection to the lift charge of the pyrotechnic device;

a second electric match component for connection to the time fuse connected to the burst charge of the pyrotechnic device; and a shrouding for isolating the junction of the second electric match component and the time fuse from the lift charge;

wherein when (i) the first electric match component is connected to the lift charge of the pyrotechnic device, (ii) the second electric match component is connected to the time fuse of the pyrotechnic device, (iii) the electric match assembly is connected to the leader, and (iv) an initiation signal is applied to the leader, the first electric match component initiates the lift charge of the pyrotechnic device and the second electric match component initiates the time fuse connected to the burst charge of the pyrotechnic device, whereby the first electric match component and the second electric match component function simultaneously with one another so that the initiation of the lift charge and the initiation of the time fuse for the burst charge occur simultaneously.

2. An electric match assembly according to claim 1 wherein the electric match assembly is assembled on a single substrate.

3. An electric match assembly according to claim 1 wherein the first electric match component and the second electric match component are connected in series within the electric match assembly.

4. An electric match assembly according to claim 1 further comprising a chamber enclosing the second electric match component and a portion of the time fuse for burst charge.

5. An electric match assembly according to claim 4 wherein the chamber comprises vent holes.

6. An electric match assembly according to claim 1 wherein the time fuse comprises a sub-assembly accommodating a conventional time fuse.

7. An electric match assembly according to claim 6 further comprising a safety plug.

8. A pyrotechnic device comprising:

a lift charge;

a burst charge;

a time fuse connected to the burst charge;

a leader carrying an initiation signal;

an electric match assembly for connection to the leader, the electric match assembly comprising:

a first electric match component connected to the lift charge;

a second electric match component connected to the time fuse connected to the burst charge; and a shrouding for isolating the junction of the second electric match component and the time fuse from the lift charge;

wherein when (i) the first electric match component is connected to the lift charge, (ii) the second electric match component is connected to the time fuse, (iii) the electric match assembly is connected to the leader, and (iv) an initiation signal is applied to the leader, the first electric match component initiates the lift charge and the second electric match component initiates the time fuse connected to the burst charge, whereby the first electric match component and the second electric match component function simultaneously with one another so that the initiation of the lift charge and the initiation of the time fuse for the burst charge occur simultaneously.

9. A pyrotechnic device according to claim 8 wherein the electric match assembly is assembled on a single substrate.

10. A pyrotechnic device according to claim 8 wherein the first electric match component and the second electric match component are connected in series within the electric match assembly.

11. A pyrotechnic device according to claim 8 further comprising a chamber enclosing the second electric match component and a portion of the time fuse for burst charge.

12. A pyrotechnic device according to claim 11 wherein the chamber comprises vent holes.

13. A pyrotechnic device according to claim 8 wherein the time fuse comprises a sub-assembly accommodating a conventional time fuse.

14. A pyrotechnic device according to claim 13 further comprising a safety plug.

* * * * *